US005991144A

United States Patent [19]

DePuy

[11] Patent Number: 5,991,144

[45] Date of Patent: Nov. 23, 1999

[54] CIRCUIT FOR TRIPPING BREAKER

[75] Inventor: Robert P. DePuy, Cherry Hill, N.J.

[73] Assignee: General Electric Company, Schenectady, N.Y.

[21] Appl. No.: 08/775,959

[22] Filed: Jan. 3, 1997

[51] Int. Cl.[6] ..... H01H 47/10

[52] U.S. Cl. ..... 361/194; 361/154; 361/206

[58] Field of Search ..... 361/194, 160, 361/170, 154, 152, 102, 115, 206; 335/173, 13

[56] References Cited

U.S. PATENT DOCUMENTS 3,560,807 2/1971 Urfer et al. ..... 361/434

4,000,445 12/1976 Wilson ..... 361/102

4,535,380 8/1985 Geary ..... 361/256

*Primary Examiner*—Fritz Fleming

*Attorney, Agent, or Firm*—Carl B. Horton

[57] ABSTRACT

An apparatus for tripping a circuit breaker having a trip coil. A trip circuit is coupled at a first node to a first power supply and at a second node to the trip coil. The trip circuit comprises a switch for closing in response to a control signal, a coil coupled to the switch so that current is allowed to flow through the coil when the switch closes, relay contacts operatively coupled to the coil so that the relay contacts close when current flows through the coil, and a zener diode for providing a low impedance path after the relay contacts close and for applying a holding voltage across the coil sufficient to keep the relay contacts closed while current flows through the low impedance path.

10 Claims, 3 Drawing Sheets

CIRCUIT FOR TRIPPING BREAKER

BACKGROUND OF THE INVENTION

1. Field of the Invention

The present invention relates to relay circuits and, in particular, to trip circuits for tripping a breaker in response to an overcurrent control signal.

2. Description of the Related Art

Relay circuits are widely used in many applications, such as power systems. Typical uses include protection of utility and industrial feeders and short circuit and overload protection for transformers and motors. Such relays typically include both overcurrent detection circuitry that generates a trip control signal after overcurrent is detected and a trip circuit to energize a breaker trip circuit when the trip control signal is generated. The overcurrent detected may be based on a time or instantaneous overcurrent. Thus, for example, whenever an overcurrent is detected, the overcurrent detection circuitry generates a trip control signal, which is applied to the trip circuit. When the trip circuit receives the trip control signal, the trip circuit causes an appropriate circuit breaker to trip, thus protecting the device or system in which an overcurrent has been detected.

In prior trip circuits, the trip circuit may include a set of relay contacts and a relay coil coupled to the trip control signal. When the trip control signal is applied to the relay coil, the relay contacts are closed, thereby providing a current path for a large current to flow through the closed relay contacts and through a trip coil of the circuit breaker, thereby causing the circuit breaker to trip after the current flows through the circuit breaker trip coil for a sufficient duration of time.

One disadvantage of such trip circuits is that the relay contacts must be large enough to handle the large magnitude of current that is required to flow therethrough in order to trip the circuit breaker. Therefore, the trip control signal must supply a relatively large amount of power to the relay coil in order to close the relay contacts. This power requirement can be undesirable, since the relay system containing the overcurrent detection circuitry and trip circuit often must be self-powered. Additionally, the relay contacts must be held in the closed position by the relay coil until the circuit breaker trips. This increases the power required to trip the breaker, since the trip control signal must be applied to the relay coil until the circuit breaker trips. Further, if the trip control signal is removed from the relay coil for any reason before the circuit breaker trips, the relay contacts may be damaged because they are not normally rated to interrupt the circuit breaker trip coil circuit.

There is a need for improved trip circuits that have lower power requirements and that do not require trip control signals of as long a duration. There is also a need for methods and apparatuses for testing whether such circuits are functioning properly.

SUMMARY OF THE INVENTION

In the present invention, a trip circuit is provided for tripping a circuit breaker having a trip coil. The trip circuit is coupled at a first node to a first power supply and at a second node to the trip coil. The trip circuit has a switch that closes in response to a control signal. A coil is coupled to the switch so that current is allowed to flow through the coil when the switch closes. Relay contacts are operatively coupled to the coil so that the relay contacts close when current flows through the coil. A zener diode is coupled between the first power supply and the relay contacts, and provides a low impedance path between the first power supply and the relay contacts after the relay contacts close.

The zener diode also applies a holding voltage across the coil sufficient to keep the relay contacts closed while current flows through the low impedance path and the relay contacts.

DESCRIPTION OF THE PREFERRED EMBODIMENT

Figure 1:
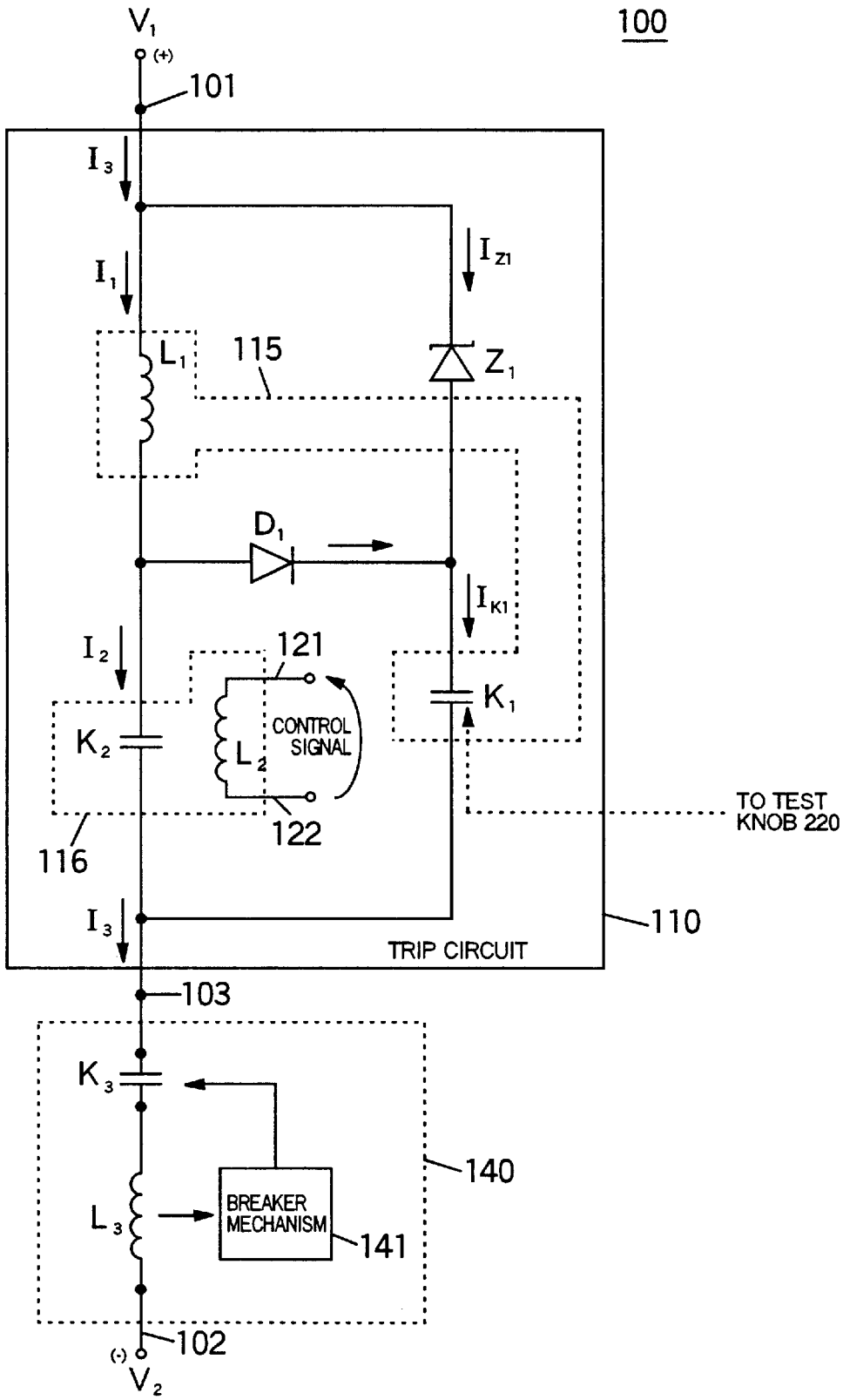
FIG. 1 is a schematic diagram of a circuit containing a trip circuit in accordance with the present invention.

Referring now to FIG. 1, there is shown a schematic diagram of a circuit 100 in accordance with the present invention. Circuit 100 includes trip circuit 110, circuit breaker portion 140, and terminals (or "nodes") 101, 102, and 103. Terminals 101 and 102 are coupled, respectively, to voltage supplies $V_1$ and $V_2$.

Circuit breaker 140 comprises trip coil $L_3$, breaker mechanism 141, and auxiliary breaker contacts $K_3$. Trip coil $L_3$ is operatively coupled to breaker mechanism 141, so that when current $I_3$ has a sufficiently high magnitude, trip coil $L_3$ trips breaker mechanism 141, causing breaker mechanism 141 to open one or more breaker main contacts (not shown) in order to protect the device or system in which an overcurrent was detected. When breaker mechanism 141 is tripped, it also opens auxiliary breaker contacts $K_3$.

Trip circuit 110 comprises relay 115, which comprises relay coil $L_1$ and relay contacts $K_1$. Relay contacts $K_1$ comprise both upper and lower contacts, which physically contact each other when relay contacts $K_1$ are closed. The lower contact of relay contacts $K_1$ is operatively coupled to for manual closure by test knob 220, as described in further detail below with respect to FIGS. 2 and 3. Trip circuit 110 also comprises reed switch relay 116, which comprises reed switch contacts $K_2$ and reed switch coil $L_2$. Circuit 110 further comprises zener diode $Z_1$ and diode $D_1$. Coil $L_2$ is coupled to an input control signal at input terminals 121 and 122. The control signal is received from overcurrent detection circuitry (not shown) that applies a control signal to input terminals 121 and 122 after the overcurrent detection circuitry detects an overcurrent in a monitored device or system (not shown). Coil $L_1$ of relay 115 is operatively coupled to relay contacts $K_1$, so that when current $I_1$ has a sufficiently high magnitude, coil $L_1$ causes relay contacts $K_1$ to close. Coil $L_2$ of relay 116 is operatively coupled to reed switch contacts $K_2$, so that when the control signal is applied to input terminals 121 and 122, the current generated through coil $L_2$ is sufficient to cause reed switch contacts $K_2$ to close.

As illustrated in FIG. 1, coil $L_1$ is coupled at node 101 to the cathode of zener diode $Z_1$ and at its other terminal to the anode of diode $D_1$ and to a terminal of reed switch contacts $K_2$. The cathode of diode $D_1$ and anode of zener diode $Z_1$ are coupled through relay contacts $K_1$ to node 103 and to the other end of reed switch contacts $K_2$. Node 103 of trip circuit 110 is coupled, through auxiliary breaker contacts $K_3$ of circuit breaker 140, to a terminal of trip coil $L_3$ of circuit breaker 140. The other terminal of trip coil $L_3$ is coupled to node 102.

In one embodiment, zener diode $Z_1$ has a 5 V breakdown voltage; trip coil $L_3$ causes auxiliary breaker contacts $K_3$ to open when current $I_3$ rises above approximately 5 A; coil $L_1$ causes relay contacts $K_1$ to close when current $I_1$ rises above approximately 0.05 A; and coil $L_2$ causes reed switch contacts $K_2$ to close when a control signal of at least 4 V is applied to input terminals 121 and 122. As explained below, upon receipt of an input control signal, trip circuit 110 provides a low impedance path between nodes 101 and 103, so that most of the voltage differential ($V_1-V_2$) is across trip coil $L_3$. In one embodiment, the voltage differential ($V_1-V_2$) is 125 V, which is sufficient to generate a voltage across trip coil $L_3$ of approximately 120 V, which is sufficient to trip breaker mechanism 141.

In operation, trip circuit 110 is initially an open circuit between nodes 101 and 103, since reed switch contacts $K_2$ and relay contacts $K_1$ are initially open. Auxiliary breaker contacts $K_3$ are initially closed, since breaker mechanism 141 has not yet tripped. Therefore, initially, voltage differential ($V_1-V_2$) is applied across nodes 101 and 103, with no current $I_3$ flowing through trip coil $L_3$. When an overcurrent is detected in the system which circuit breaker 140 is designed to protect, a control signal is received at input terminals 121, 122. The control signal applied to coil $L_2$ causes reed switch contacts $K_2$ to close. At this point, relay contacts $K_1$ are open and zener diode $Z_1$ conducts no current $I_{Z1}$, and the voltage differential ($V_1-V_2$) causes current $I_3=I_1=I_2$ to flow, at an initial magnitude. Since relay contacts $K_1$ are open, no current $I_{Z1}$ can flow through zener diode $Z_1$, since diode $D_1$ will not allow the current $I_{Z1}$ to pass from the cathode-to-anode of diode $D_1$. Thus, the voltage across coil $L_1$ is higher than the voltage across zener diode $Z_1$, causing the current of coil $L_1$ to rise more quickly and to close relay contacts $K_1$ more quickly than if there was a current $I_{Z1}$ flowing through zener diode $Z_1$. In one embodiment, the impedance of relay coil $L_1$ is selected so that the impedance ratio of relay coil $L_1$ to trip coil $L_3$ causes the voltage drop across relay coil $L_1$ to be many times the voltage drop $V_{Z1}$ across zener diode $Z_1$, until relay contacts $K_1$ close and causes a holding voltage ($V_{Z1}-V_{D1}$) to be imposed across relay coil $L_1$, where $V_{D1}$ is the forward voltage drop across diode $D_1$.

Thus, current $I_1$ rises quickly in coil $L_1$ and causes relay contacts $K_1$ to be closed a short time after reed switch contacts $K_2$ were closed in response to the control signal. When relay contacts $K_1$ close, current $K_1$ flows therethrough, and current $I_{Z1}$ flows through zener diode $Z_1$ after its breakdown voltage is reached. Thus, zener diode $Z_1$ limits the voltage on coil $L_1$ to a holding voltage equal to the breakdown voltage of zener diode $Z_1$ minus the forward voltage drop across diode $D_1$. This limits the current $I_1$ to a maximum magnitude to prevent damage to coil $L_1$, since any extra current flows through zener diode $Z_1$. Additionally, at this point, a high-magnitude current path is provided, primarily through zener diode $Z_1$ and relay contacts $K_1$, since the breakdown voltage of zener diode $Z_1$ has been reached.

Thus, a current path through zener diode $Z_1$ and relay contacts $K_1$ is provided through trip circuit 110 with a sufficiently low impedance so that $I_3$ reaches a magnitude large enough to trip breaker mechanism 141. Other currents of much smaller magnitudes flow through coil $L_1$ and diode $D_1$. Once contacts $K_1$ are closed, trip circuit 110 is said to be sealed in, since relay coil $L_1$ will maintain relay contacts $K_1$ in a closed position until breaker mechanism 141 is tripped, even if the control signal is removed and/or reed switch contacts $K_2$ are opened. As will be appreciated, trip circuit 110 stays sealed in because, zener diode $Z_1$ still provides a holding voltage across coil $L_1$, keeping relay contacts $K_1$ closed, even if reed switch contacts $K_2$ are opened.

The ability of trip circuit 110 to be sealed in in this manner is advantageous as it allows trip circuit 110 to operate without its own power supply, and does not require the control signal to be applied to reed switch coil $L_2$ until breaker mechanism 141 is tripped, but only until contacts $K_1$ are closed. Further, as will be appreciated, the power required to operate relay 116 is much smaller than the power required to operate relay 115. Thus, the power required of the control signal is much lower than it would be if the control signal were required to operate a relay such as relay 115.

It may be desired to test trip circuit 110, for example to test the current path from power supply $V_1$ at node 101 to node 103, the integrity of the wiring between node 103 of trip circuit 110 and circuit breaker 140, and the current path of circuit breaker 140 from node 103 to power supply $V_2$ at node 102. One way to test trip circuit 110 would be to apply a control signal to terminals 121 and 122 of reed switch coil $L_2$. However, this may be undesirable because it would require the tester to have a power supply available, and also because it may be inconvenient to access terminals 121 and 122 or to disconnect the overcurrent protection circuitry from these terminals. Another way to test trip circuit is to short circuit relay contacts $K_1$, for example by coupling a wire around the contacts. However, this may also be undesirable and dangerous to a human operator since a large voltage may exist across relay contacts $K_1$. Therefore, a mechanical means for testing trip circuit by mechanically closing relay contacts $K_1$ are provided herein.

Figure 2:
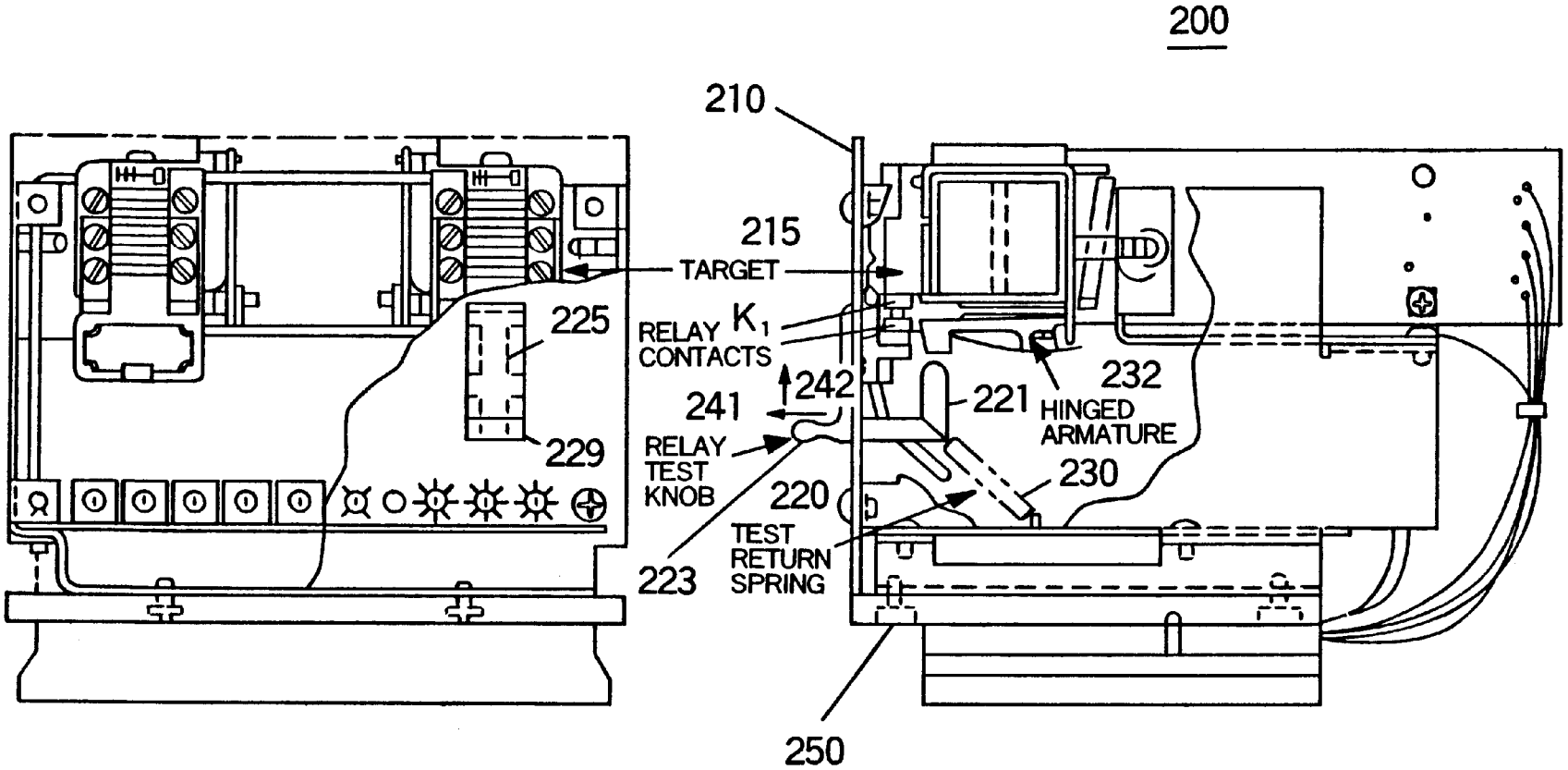
FIG. 2 depicts front and side perspective views of a housing with face plate, target and test knob for housing and testing the trip circuit of FIG. 1.

Referring now to FIG. 2, there are depicted front and side perspective views of a housing 200 with face plate 210, target 215, and test knob 220 for housing and testing trip circuit 110 of FIG. 1. Housing 200 houses trip circuit 110, including the upper and lower contacts of relay contacts $K_1$ of relay 115. The face plate 210 contains an channel 225 in which test knob 220 may be moved up or down. Channel 225 also contains a retention hole 229 in face plate 210, to provide a secured rest position for test knob 220, as described below. Target 215 is also mounted on face plate 210 and is operated by relay 115. Housing 200 also comprises a test return spring 230 for coupling test knob 220 to base 250 of housing 200, as described in further detail below. Housing 200 further includes hinged armature 232, which is coupled to the lower contact of relay contacts $K_1$ so that relay contacts $K_1$ may be closed by moving test knob 220, and thus armature 232, upwards, as described further below. In one embodiment, test knob 220 consists of a non-conducting material, such as plastic, to protect a user from possible electrical shock from test circuit 110 while manipulating test knob 220.

As will be appreciated, when relay contacts $K_1$ of relay 115 close, relay contacts $K_1$ physically move together, as illustrated in FIG. 2. Target 215 is mounted and operatively coupled to relay contacts $K_1$ such that, when relay contacts $K_1$ are closed, the target 215 is set. The target 215 comprises a target indicator which displays a visual indication to indicate whether or not relay contacts $K_1$ of relay 115 have been closed.

Figure 3:
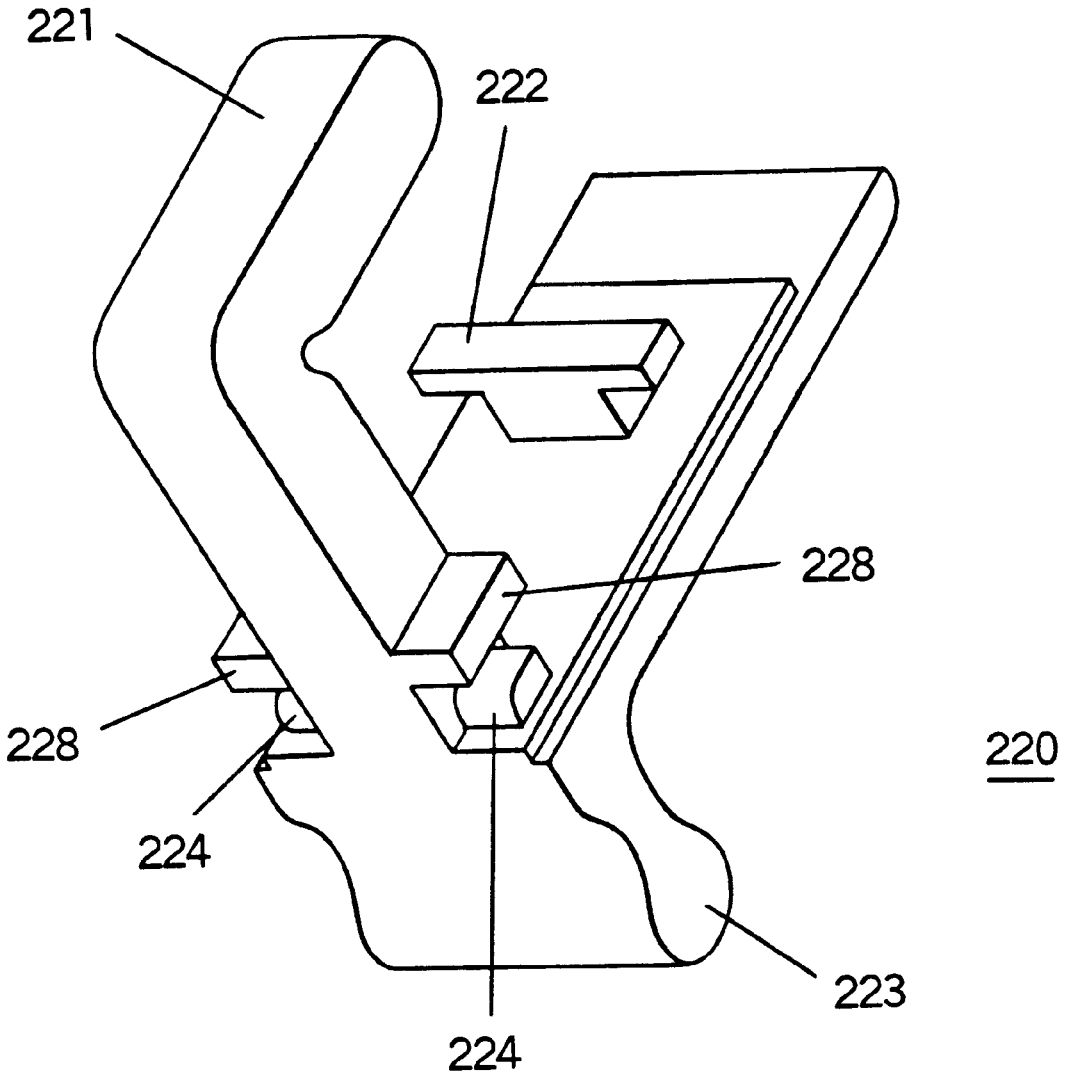
FIG. 3 depicts a perspective view of test knob 220 of the housing of FIG. 2.

Referring now to FIG. 3, there is depicted a perspective view of test knob 220. Test knob 220 comprises knob portion 223, retention tab 222, retention flange 228, a stop or stop 210 tabs 224, and back portion 221. Test knob 220 is slidably secured in channel 225 of face plate 210, so that test knob may slide up or down. Test knob 220 is coupled at its back portion 221 to base 250 of housing 200 via test return spring 230. The lower contact of relay 115 contacts $K_1$ is attached to a hinged armature 232 so that if armature 232 is moved upwards from a rest position, relay contacts $K_1$ close. Test knob 220 is mounted so that its back portion will push armature 232 upward when test knob 220 is moved upward in channel 225 by a user. Stop 224 and spring 230 help to prevent accidental operation of test knob 220 by requiring the test knob to be pulled and lifted in order to perform the test. Retention tab 222 and retention flange 228 mount behind the face plate 210 to keep test knob 220 secured.

Retention tab 222 is also mounted in target 215 to limit the stroke of the test knob 220.

Initially, test knob 220 is in a rest position, with stop 224 placed in a retention hole 229 in face plate 210. Thus, in this initial rest position, knob 220 is fixed in its lower position and is unable to slide upwards in track 225. In order to operate test knob 220 to close relay contacts $K_1$, a user pulls on knob portion 223 directly away from face plate 210, as illustrated by arrow 241, thereby removing stop 224 from the retention hole 229. Retention tab 222 and retention flange 228 prevent knob 220 from being removed completely from face plate 210 in response to further pulling in the direction of arrow 241. Test knob 220 is at this point is free to slide up in track 225, as illustrated by arrow 242. The user then slides test knob 220 upwards, which causes back portion 221 to move hinged armature 232 upwards, causing contacts $K_1$ to close and target 215 to be set. If trip circuit 110 is operating properly and properly coupled to voltage supply $V_1$ and circuit breaker 140, when contacts $K_1$ are closed, trip circuit 110 becomes sealed in and breaker mechanism 141 of circuit breaker 140 trips. Thus, if a user moves test knob 220 upwards as described above, and target 215 is set and breaker mechanism 141 trips, the current path integrity for tripping has been tested.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. An apparatus for tripping a circuit breaker having a trip coil, comprising a trip circuit coupled at a first node to a first power supply and at a second node to the trip coil, the trip circuit comprising:

(a) a switch for closing in response to a control signal;

(b) a coil coupled to the switch so that current is allowed to flow through the coil when the switch closes;

(c) relay contacts operatively coupled to the coil so that the relay contacts close when current flows through the coil; and (d) a zener diode coupled between the first power supply and the relay contacts for providing a low impedance path between the first power supply and the relay contacts after the relay contacts close and for applying a holding voltage across the coil sufficient to keep the relay contacts closed while current flows through the low impedance path and the relay contacts.

2. The apparatus of claim 1, further comprising mechanical means for closing the relay contacts.

3. The apparatus of claim 1, further comprising a housing for housing the trip circuit, the housing comprising:

(1) a face plate;

(2) a test knob mounted in a sliding channel of the face plate, the test knob having a knob portion accessible from the exterior of the face plate and a back portion, wherein the relay contacts comprise first and second relay contacts; and (3) an armature for mounting the second relay contact, wherein the armature is operatively coupled to the back portion of the test knob so that moving the test knob in the sliding channel causes the relay contacts to close.

4. The apparatus of claim 3, wherein the face plate further comprises a retention hole in the sliding channel and the test knob comprises a stop tab means for securing the test knob in a rest position in the sliding channel when the stop tab means is inside the retention hole, the housing further comprising a spring coupled between the test knob and the housing to pull the stop tab means into the retention hole.

5. The apparatus of claim 4, wherein the test knob further comprises retention tab means for securing the test knob to the face plate.

6. The apparatus of claim 1, wherein the current flowing through the low impedance path is sufficient to cause the trip coil to trip the circuit breaker.

7. The apparatus of claim 1, wherein the switch is a reed switch and the trip circuit further comprises a reed switch coil coupled to the control signal and operatively coupled to the reed switch so that the reed switch coil causes the reed switch to close in response to the control signal.

8. The apparatus of claim 1, wherein: the relay contacts comprise first and second relay contacts; the switch is a reed switch coupled at a first terminal to the trip coil and to the first relay contact; the reed switch is coupled at a second terminal to a first terminal of the coil and to the anode of a diode; a second terminal of the coil is coupled to the first power supply and to the cathode of the zener diode; and the anode of the zener diode is coupled to the cathode of the diode and to the second relay contact.

9. An apparatus for tripping a circuit breaker having a trip coil, comprising a trip circuit and a housing for housing the trip circuit, wherein the trip circuit comprises:

(a) a switch for closing in response to a control signal, wherein the trip circuit is coupleable at a first node to a first power supply and at a second node to the trip coil;

(b) a coil coupled to the switch so that current is allowed to flow through the coil when the switch closes;

(c) relay contacts operatively coupled to the coil so that the relay contacts close when current flows through the coil; and (d) means for providing a low impedance path after the relay contacts close and for applying a holding voltage across the coil sufficient to keep the relay contacts closed while current flows through the low impedance path; and the housing comprises:

(1) a face plate;

(2) a test knob mounted in a sliding channel of the face plate, the test knob having a knob portion accessible from the exterior of the face plate and a back portion, wherein the relay contacts comprise first and second relay contacts; and (3) an armature for mounting the second relay contact, wherein the armature is operatively coupled to the back portion of the test knob so that moving the test knob in the sliding channel causes the relay contacts to close.

10. A trip circuit for tripping a circuit breaker having a trip coil, the trip circuit comprising:

(a) a switch for closing in response to a control signal, wherein the trip circuit is coupleable at a first node to a first power supply and at a second node to the trip coil;

(b) a coil coupled to the switch so that current is allowed to flow through the coil when the switch closes;

(c) relay contacts operatively coupled to the coil so that the relay contacts close when current flows through the coil; and (d) means, comprising a zener diode, for providing a low impedance path after the relay contacts close and for applying a holding voltage across the coil sufficient to keep the relay contacts closed while current flows through the low impedance path.

* * * * *